US005167373A

United States Patent [19]

Bohn et al.

[11] Patent Number: 5,167,373

[45] Date of Patent: Dec. 1, 1992

[54] CONTROLLED INTENSITY HIGH SPEED DOUBLE DISC REFINER

[75] Inventors: William L. Bohn, Williamsport; Gary L. Jackson, Montoursville, both of Pa.; Martin J. Sferrazza, Springfield, Ohio

[73] Assignee: ABB Sprout-Bauer, Inc., Muncy, Pa.

[21] Appl. No.: 638,750

[22] Filed: Jan. 8, 1991

[51] Int. Cl.[5] ..... B02C 7/06

[52] U.S. Cl. ..... 241/28; 241/261.2

[58] Field of Search ..... 241/30, 36, 261.2, 28, 241/261.3, 296, 297, 298, 259.1, 259.2, 259.3

[56] References Cited

U.S. PATENT DOCUMENTS 2,035,994 3/1936 Sutherland ..... 241/259.1 X
3,467,323 9/1969 Asplund et al. .
3,523,649 8/1970 Laakso .
3,765,613 10/1973 Steiniger .
3,889,890 6/1975 Horstman ..... 241/261.2 X

FOREIGN PATENT DOCUMENTS 1297458 6/1969 Fed. Rep. of Germany .

*Primary Examiner*—Mark Rosenbaum
*Attorney, Agent, or Firm*—Chilton, Alix & Van Kirk

[57] ABSTRACT

A double disc refiner apparatus (10) and associated method, in which two counter-rotating refiner discs (26,28) which define a refining zone (58) therebetween, are counter-rotated at different steady-state speeds, such as 1800 rpm and 1200 rpm. For energy-efficiency, the feed end disc (26) is rotated at a faster speed than the control end disc (28), but in some instances, desired refiner output quality can be achieved by rotating the control end disc faster than the feed end disc.

6 Claims, 13 Drawing Sheets

HIGH SPEED REFINING

*RESIDENCE TIMES FOR DDR*

| CONSISTENCY | 1200 RPM | 1800 RPM |
|---|---|---|
| 30 % | 0.506 SECS. | 0.150 SECS. |
| 40 % | 0.634 SECS. | 0.188 SECS. |
| 50 % | 0.749 SECS. | 0.222 SECS. |

CONTROLLED INTENSITY HIGH SPEED DOUBLE DISC REFINER

BACKGROUND OF THE INVENTION

The present invention relates to disc refiners, and more particularly, to an improved method and apparatus for rotating the discs of a double disc refiner.

Double-disc refiners have been utilized for many years to refine pulp and similar material by subjecting the pulp to the heat and stresses generated as the pulp passes radially through closely spaced, counter-rotating discs. The typical drive speed for the discs in North America, is 1200 rpm. It is known, however, that operation of a double disc refiner at 1800 rpm reduces energy consumption by approximately 20 percent to produce the same freeness in the refined product as rotation at 1200 rpm. This energy benefit is reduced, however, by the substantial equipment cost increase associated with driving both discs at 1800 rpm.

SUMMARY OF THE INVENTION

It is one object of the present invention to provide apparatus and method by which a double disc refiner can achieve the reduction in energy consumption similar to that achieved with a double disc refiner operating at 1200 rpm, while maintaining or improving the pulp quality achieved in double disc refiners that operate at 1800 rpm. This object is accomplished by operating one disc of the double disc refiner at a relatively high speed, and the other at a relatively low speed. More specifically, in a double disc refiner having a feed end disc through which feed material is introduced to the refining zone between the feed end disc and a counter rotating control end disc, the present invention achieves the desired results by rotating the control end disc at a slower speed than the rotation of the feed end disc.

In a typical implementation of the present invention, the feed end disc is rotated at 1800 rpm, and the control end disc at 1200 rpm. Other absolute and relative speeds of counter-rotation can also provide advantageous results relative to the conventional counter-rotation of both discs at the same speed. Testing has demonstrated that, where pulp consistency, pressure drop, and power split are maintained consistently between trial runs, the use of 1800 rpm for the feed end disc and 1200 rpm for the control end disc produces the surprising result that both the reduction in energy consumption and the quality of the pulp, are similar to high speed refining where both discs counter-rotate at 1800 rpm.

The obvious advantage flowing from this discovery, is that only one high speed motor is required on the refiner, rather than two high speed motors, at a considerable savings in equipment costs. This savings is achieved especially with the retrofit of an existing refiner for improved energy utilization and to a lesser extent with the fabrication of a new double disc refiner for delivery.

Another object of the invention is to provide greater flexibility in the refining intensity of a double disc refiner. In accordance with another embodiment, if a double disc refiner is operated with the control end disc rotating at 1800 rpm and the feed end disc counter-rotating at 1200 rpm, the net result is lower intensity refining and high tear strength, but without substantial energy savings relative to counter-rotating both discs at 1200 rpm.

Thus, the present invention provides significantly greater control of the refining process, as a result of the utilization of different drive speeds for the opposed discs of a double disc refiner system. Preferably, one disc is rotated at a speed greater than about 1500 rpm and the other disc rotated at a speed less than 1500 rpm. It has been found that for energy optimization purposes, the feed end disc should be operated approximately 50 percent faster than the control end disc. Where particular product characteristics are desired, and energy considerations are secondary, the speed of one disc could lie anywhere in the range of about 25 to 75 percent greater than the speed of the other disc. For example, if one disc is rotated at 1200 rpm, the other disc can be rotated at a speed somewhere between 1500 rpm (25 percent greater than 1200 rpm) and 2100 rpm (75 percent greater than 1200 rpm).

BRIEF DESCRIPTION OF THE DRAWINGS

These and other objects and advantages of the invention will be evident from the description of the preferred embodiment set forth below, made with reference to the accompanying drawings, in which.

DESCRIPTION OF THE PREFERRED EMBODIMENT

Figure 1:
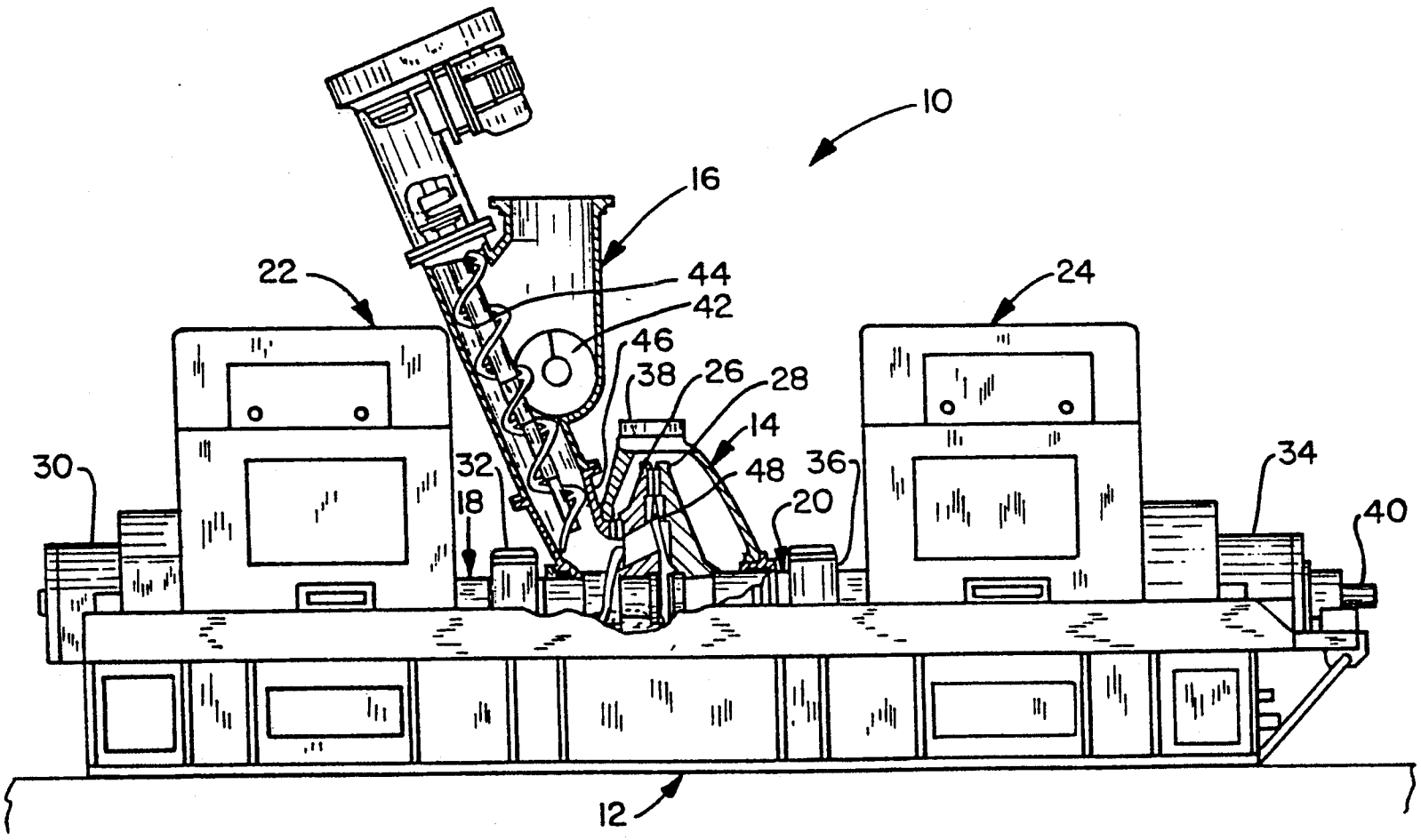
FIG. 1 is an elevation view, partly cut away, showing a double disc refiner apparatus of the type suitable for implementing the present invention.

FIG. 1 shows a double disc refiner of the type particularly well-suited for implementation of the present invention. The refiner 10 is carried on a base or platform 12 and provides, as the primary functional component, a casing 14 into which feedstock is fed through a feeder mechanism 16. First and second coaxial shafts 18,20 are independently rotated by electric motors and associated controls in the drive cabinets 22,24, outside the casing. A coaxial, spaced apart feed end disc 26 is thereby counter-rotated relative to control end disc 28 within the casing 14. The shaft 18 is supported in outer and inner bearings 30,32, and, likewise, shaft 20 is supported in outer and inner bearings 34,36. A clash control system 38 is preferably associated with casing 14, to assure that the space between the opposed discs 26,28 is maintained greater than a minimum safe value. Means for adjusting the space between the discs is also provided, as by hydraulic cylinder 40, whereby shaft 20 and associated disc 28 can be adjusted to the left and right along the shaft axis. It should be appreciated that, although the discs 26,28 shown in FIG. 1 are substantially annular, the term as used herein is meant to include functional equivalents having different shapes, such as conical or spherical mating surfaces defining a refining zone therebetween.

U.S. Pat. No. 3,765,613, "Pulp Refining System and Apparatus", the disclosure of which is hereby incorporated by reference, contains additional description of a double disc refiner of the type shown in FIG. 1. U.S. Pat. No. 3,799,456, "Refiner Plate Clearance Control System", and U.S. Pat. No. 4,950,986, "Magnetic Proximity Sensor For Measuring Gap Between Opposed Refiner Plates", the disclosures of which are hereby incorporated by reference, describe two types of clash prevention techniques that can be implemented at box 38 in FIG. 1 of the present application, but other types that are commercially available may also be suitable. The feed mechanism 16 shown in FIG. 1, is preferably the type presently commercially available from ABB Sprout-Bauer, Inc., Muncy, PA, under the trademark "Topwinder".

The motor sets in drive cabinets 22,24 generally have six poles operated with three phase 60 Hz current in North America at a speed of 1200 rpm, although it is known to operate four pole motors at 1800 rpm. In Europe, the standard speed of four pole motors is 1500 rpm due to the 50 Hz standard current. It is generally understood that conventionally both the motor and shafts rotate at a speed that is consistent with the number of poles and line current frequency.

In a manner well known to practitioners in this field, feedstock is introduced by a horizontal conveyor 42 of the feed mechanism 16, and advanced by the feed screw 44 through the feed spout 46 which penetrates casing 14. The feed material passes through the feed end disc 26 into the refining zone 48 between the discs, where the pulp is refined under the influence of the heat and friction generated by the counter-rotating discs. The pulp passes radially through the space between the discs, and is discharged from the casing 14 in a known manner.

Figure 2:
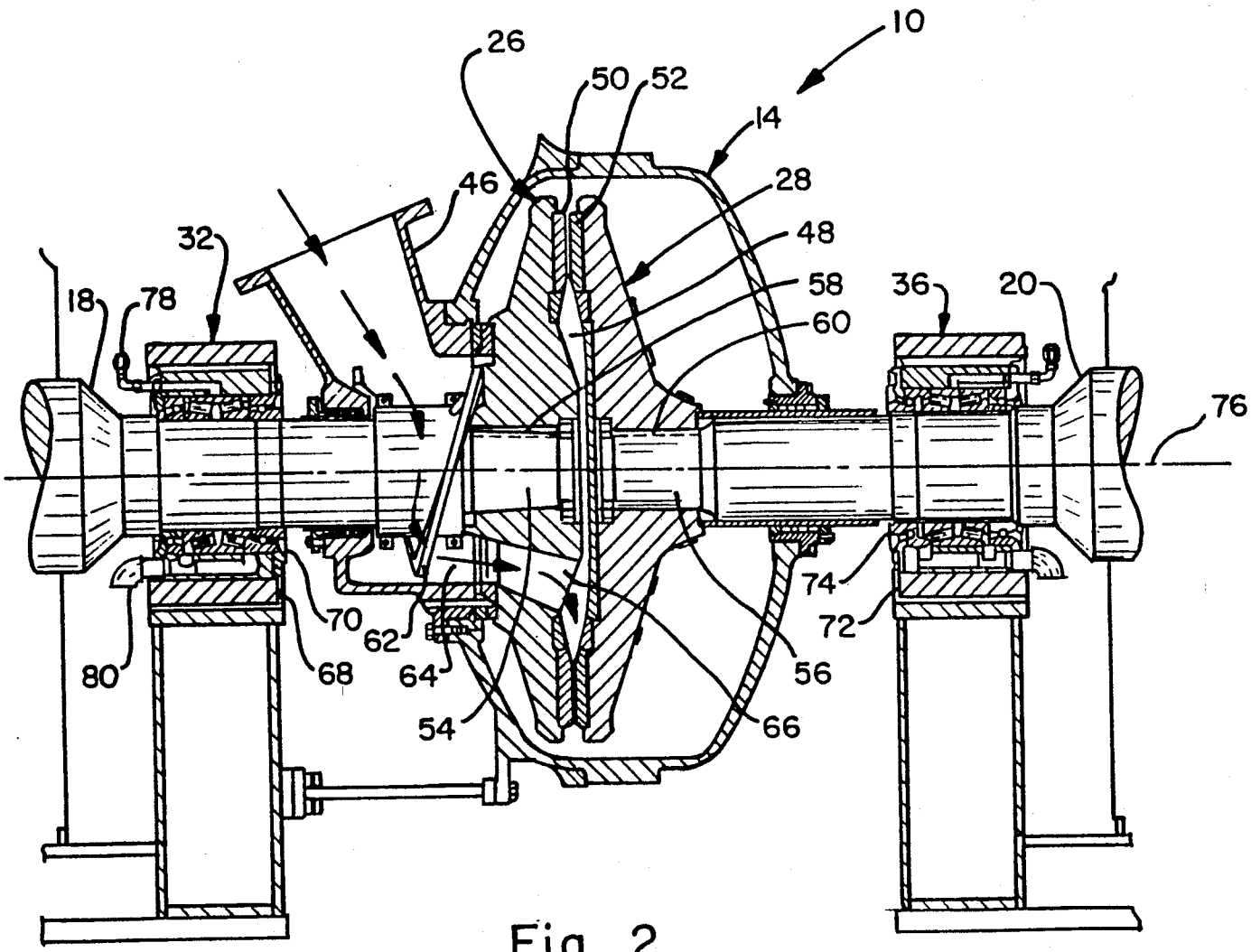
FIG. 2 is an enlarged, sectioned view of the casing and adjacent components of the refiner apparatus shown in FIG. 1.

FIG. 2 is an enlarged cross-sectional view of the casing and associated internal components. Within the casing 14, each disc 26,28 carries one or more grinding plates 50,52 which are juxtaposed and which have carefully designed surface characteristics for influencing the nature of the work performed on the pulp as it passes radially through the refining zone 48 therebetween. Each disc 26,28 is typically annular, for receiving the driven ends 54,56 of shafts 18,20, respectively, and interengaged therewith by means of interference fit including key arrangements 58,60, respectively. The feed spout 46 is connected to casing 14 and surrounds shaft 18 so as to provide a passage 64 leading to openings 66 on the feed end disc 26, adjacent the axis 76. A screw flight 62 is preferably provided on the portion of shaft 18 that passes through feed spout 46, to ensure positive feed against backflow steam and maintain the consistency of the feed pulp which traverses passage 64 into opening 66.

The discs 26,28 typically have the same outer diameter, which defines the circumferential perimeter through which the refined pulp passes just prior to extraction through the casing wall 14. Additional details on the feed disc 26 and control disc 28 may be obtained from U.S. Pat. No. 3,889,890, "Refiner Disc", and FIGS. 3 and 4 to be discussed immediately below.

The inner bearings 32,36, typically include bearing housings 68,72 and associated retention rings, for holding the bearing elements 70,74 against the rotating shafts. Lubrication and drain lines such as shown at 78,80, are provided in a manner well known in the field.

In accordance with the present invention, the double disc refiner 10 is operated so that the feed end disc 26 is rotated at a speed different from that of the control end disc 28, in order to develop particular pulp properties. Preferably, one disc is operated at a speed above about 1500 rpm, whereas the other disc is operated at a speed below about 1500 rpm. In North America, the different speeds would preferably be 1800 rpm and 1200 rpm.

Testing has shown that increasing the speed of a primary double disc refiner from the conventional 1200 rpm to 1800 rpm can reduce the overall two stage energy consumption by 20 percent. Further testing revealed that most of the energy savings is the result of the 1800 rpm speed of the feed end disc 26. On the other hand, running only the control end disc 28 at 1800 rpm improved pulp qualities at the same energy consumption as running both discs at 1200 rpm.

These observations correspond with the theory that the feed disc 26 tends to determine the residence time of the pulp in the refiner. Thus, the shorter residence time which results from higher feed end disc speed, leads to higher working intensity and lower energy, to produce a given freeness in the material. This also has the effect of reducing tear and burst at a given freeness. Because the material starts out by passing through the feed disc, it rotates along with the feed disc to a considerable extent. This tends to make the feed disc the predominate factor in determining the centrifugal force on the material. Thus, higher speed of the feed disc reduces residence time of material between the plates a greater amount than higher speed of the control end.

Figure 3:
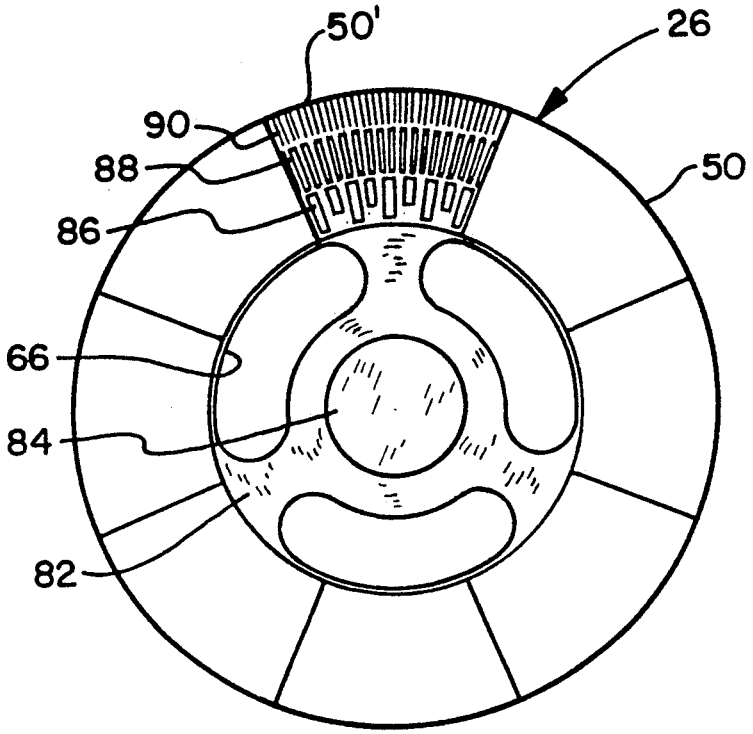
FIG. 3 is a schematic view of the face of the feed end disc shown in FIG. 2.
Figure 4:
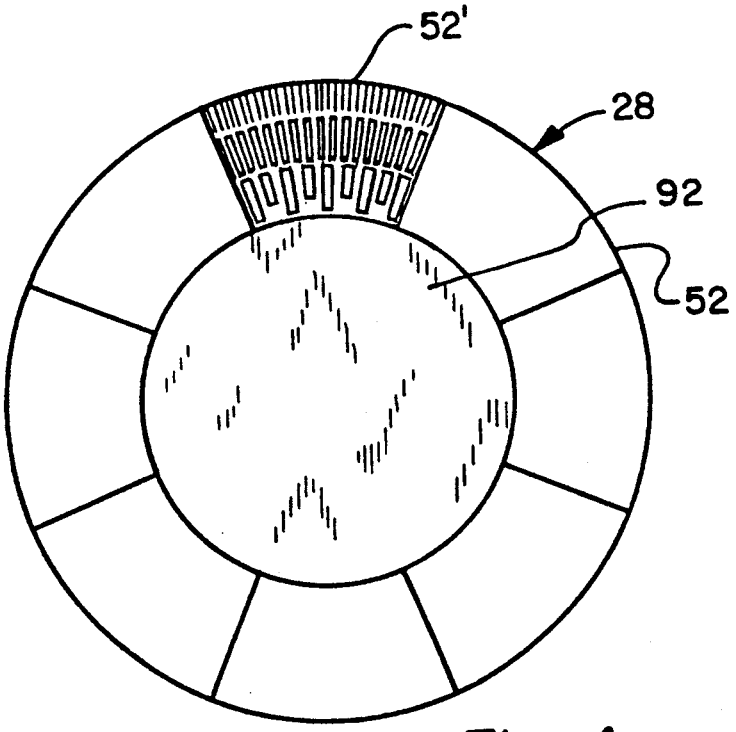
FIG. 4 is a schematic view of the face of the control end disc shown in FIG. 2.

FIGS. 3 and 4 show the confronting surfaces of the discs 26,28, respectively. Feed end disc 26 is circular and has radially inner and outer regions. The inner region includes a hub and associated cover 84 for connection to the shaft, discrete feed openings 66 surrounding the hub, and solid ligaments or spokes 82 by which the inner region is rigidly attached to the outer region. The outer region includes a plurality of side-by-side plate segments forming annular grinding plate 50. Each segment 50' is substantially identical. In the illustrated embodiment, each segment 50' has radially distinct rows of coarse, medium, and fine bars 86, 88, and 90, respectively. Circular control end disc 28 has substantially the same diameter as disc 26, and the same outer region wherein plate 52 is formed by a plurality of plate segments 52' that are typically substantially identical to segments 50' shown in FIG. 3. The inner region of control end disc 28 presents a substantially solid surface such as wear plate 92 in opposition to the inner region of the feed end disc, i.e., there are no feed openings in the control end disc 28.

It has been theorized that the feed material to a double disc refiner preferentially follows the feed end disc, because the feed end spokes 82 serve to accelerate the feed into the feed end plates 50. The control end disc, which has substantially the same bar pattern on plate 52, establishes the number and nature of the "bar crossings" necessary for each component of refining intensity to occur. The term "refining intensity" and other terms used herein, are defined in the Appendix to this specification.

Intensity, which increases as residence time decreases, is therefore also affected more by the feed disc speed than by the control disc speed. Intensity per impact (or bar crossing) is also directly affected by the relative speed of the two discs once residence time is determined. Conversely, increasing the speed of only the control disc 28 to 1800 rpm does not reduce the energy required to achieve a given freeness, relative to operating both discs at 1200 rpm. It does, however, lower intensity and this in turn increases the burst and tear indices compared to 1200 rpm operation.

Operating both discs at 1800 rpm always results in energy savings, but the pulp quality characteristics tend to vary more as a result of other operating parameters, such as throughput, consistency and pressure differential. Various tests show that qualities such as burst and tear, can be either better or worse than base line operation of both discs at 1200 rpm, depending on these other conditions.

The improved performance results and the greater control of refining intensity that are available with the present invention, can be appreciated from the quantitative comparisons shown in FIGS. 5–24. The same four refiner configurations are shown in FIGS. 5 and 7–24. The base line or reference configuration 100 is represented by the solid bar and has both discs counter-rotated at 1200 rpm. The second configuration 200 is represented by diagonal hatching and has both discs counter-rotated at 1800 rpm. The third configuration 300 shown as an open bar, has the feed end disc rotated at 1800 rpm and the control end disc rotated at 1200 rpm, and the fourth configuration 400 shown as a bar with horizontal lines, has the feed end disc rotated at 1200 rpm and the control end disc rotated 1800 rpm.

Figures 5, 6:
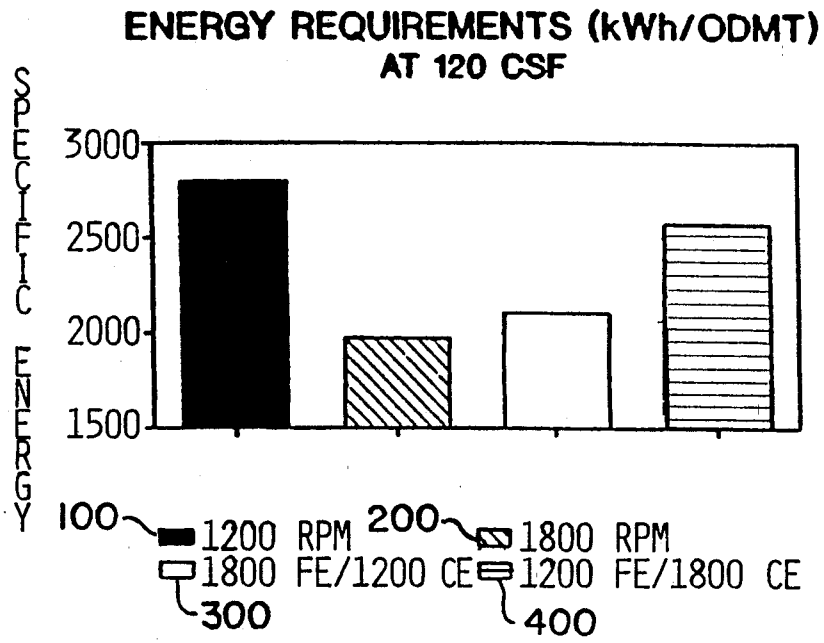
FIG. 5 is a graphic comparison of the energy requirements associated with the invention relative to known refiner configurations.
FIG. 6 is a tabulation of the residence times of the pulp material in the refining zone at different consistencies and different feed end disc speeds.

In FIG. 5, a comparison is made of the energy requirements for each of the configurations, in units of kilowatt hours per oven dry metric tons per day at a constant 120 CFS. FIG. 6 shows the residence times in the refining zone at different pulp consistencies, for the two configurations 200 and 300 wherein the discs are rotated at the same speeds, 1200 rpm and 1800 rpm. From these data, it is concluded that residence time is reduced at higher speeds, and that the high speed double disc refining, at 1800 rpm, reduces energy consumption by 25 percent relative to normal refining speed, 1200 rpm. By operating only the feed end disc at 1800 rpm, most of the savings of the base configuration 100 can be achieved.

Figure 8:
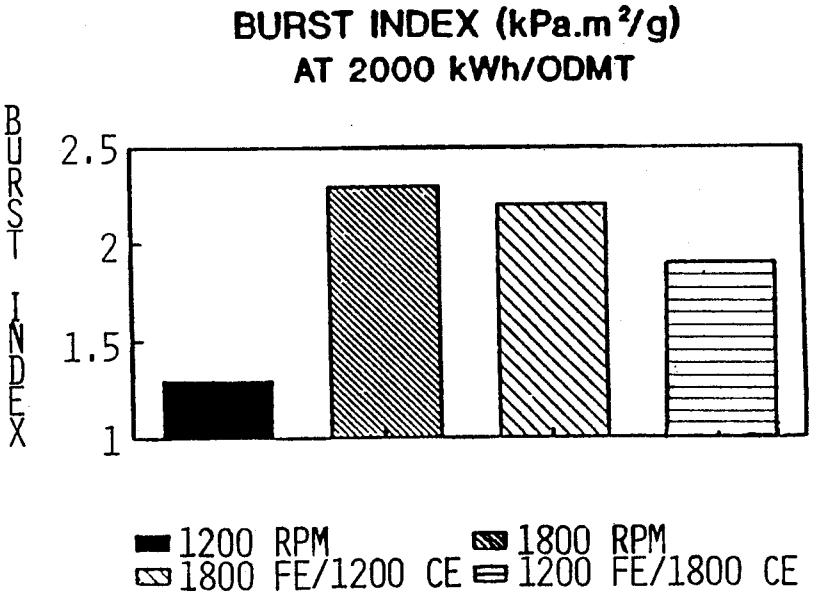
FIGS. 7 and 8 are graphic comparisons of the burst index for the invention and known configurations.
Figure 7:
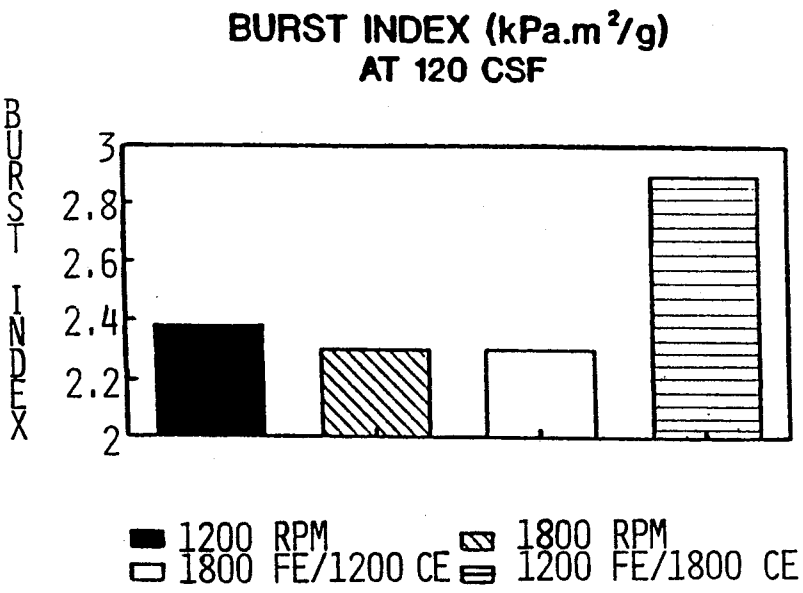

The burst index comparison is shown in FIGS. 7 and 8 for different conditions. From these data, it can be concluded that the bonding strengths at higher rotation speeds are equivalent to the strengths from the base line configuration, and that operating the control end disc at the higher speed actually improves the strength at a given freeness.

Figure 10:
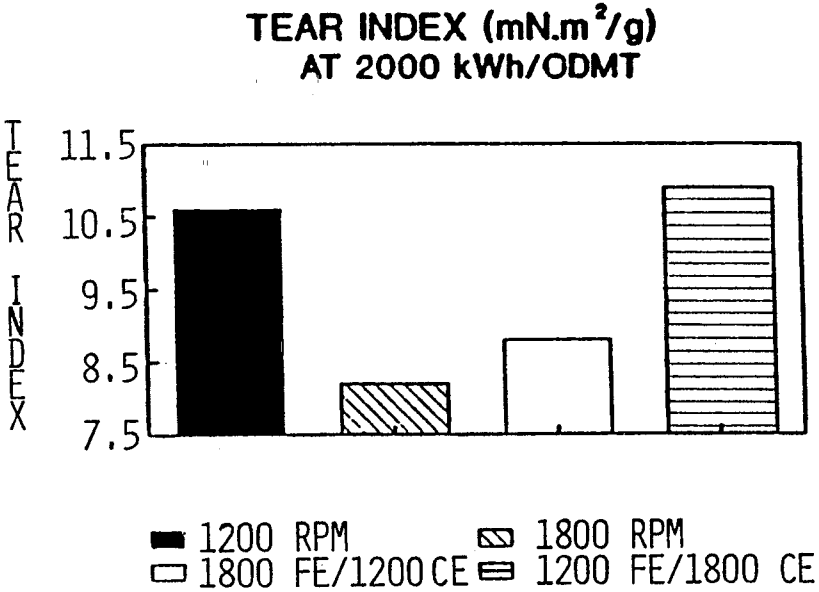
FIGS. 9 and 10 are graphic comparisons of the tear index for the invention and known refiner configurations.
Figure 9:
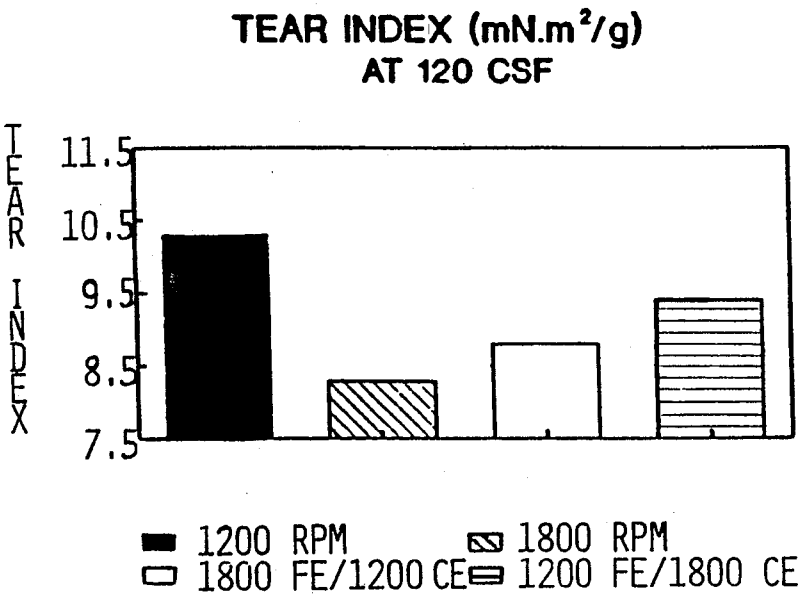

The tear index comparison is shown in FIGS. 9 and 10. From these data it can be concluded that rotation of either or both discs at higher speed than the base line configuration, reduces fiber length, so that the tear index is lowered. Operating only the control end disc at high speed, does not significantly impact the tear index, when determined on the basis of constant energy consumption rather than constant freeness.

Figure 12:
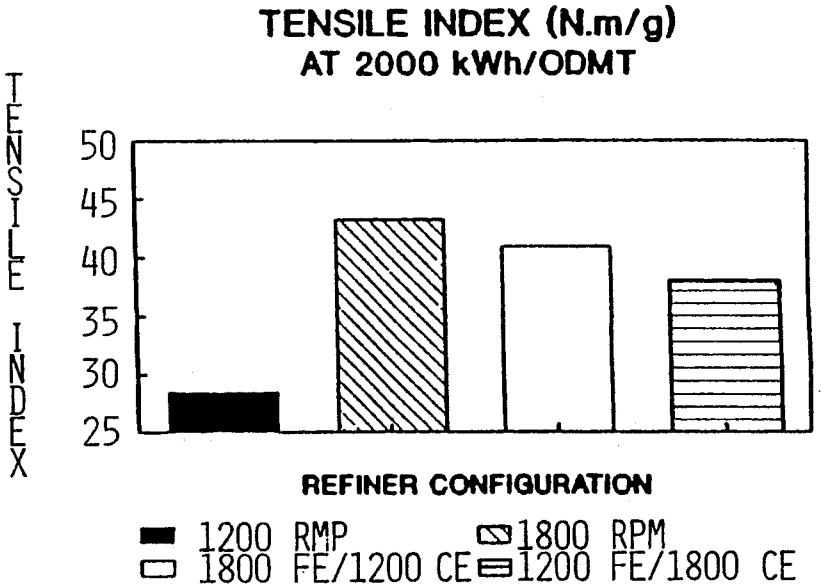
FIGS. 11 and 12 are graphic comparisons of the tensile index for the invention and known refiner configurations.
Figure 11:
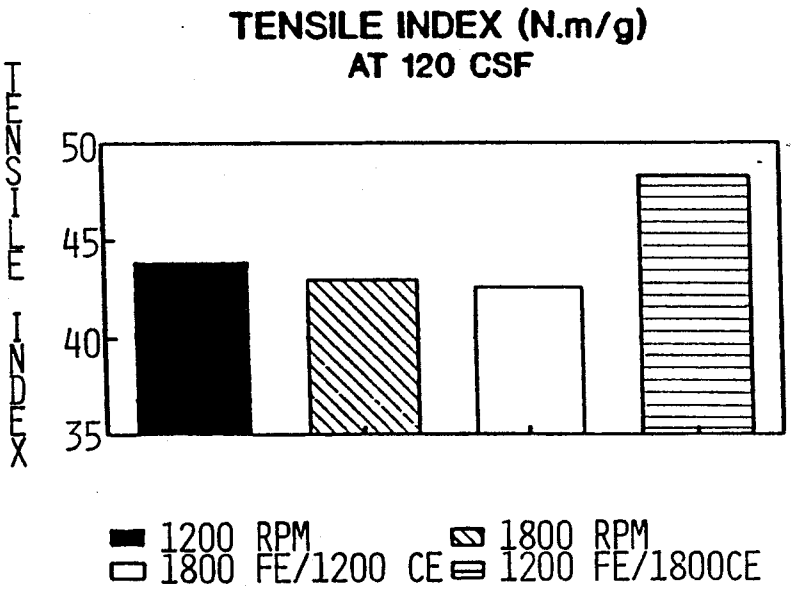

FIGS. 11 and 12 show the tensile index under two different conditions. From these data, it may be concluded that with a given energy usage, higher speeds in one or both of the discs developed better tensile strength. At a specific freeness, tensile is optimized with the control end disc only, running at the higher speed.

Figure 14:
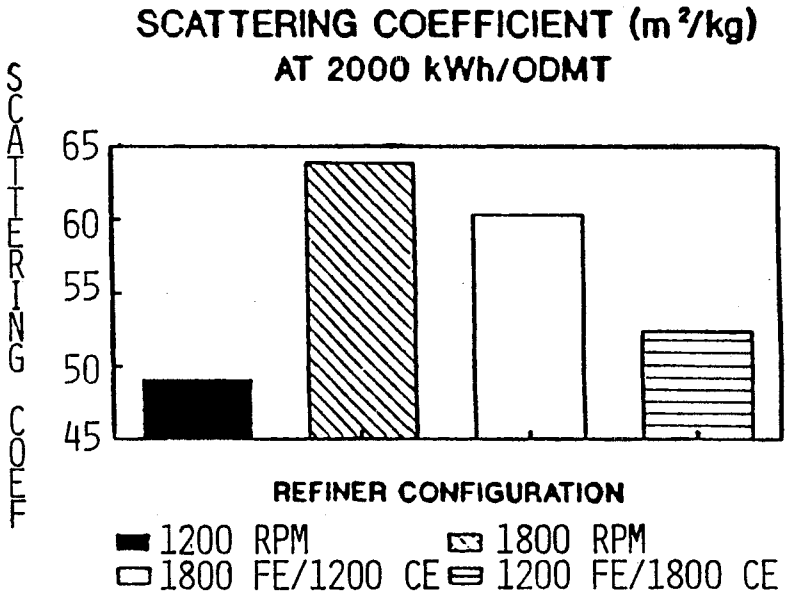
FIGS. 13 and 14 are graphic comparisons of the scattering coefficient for the invention and known refiner configurations.
Figure 13:
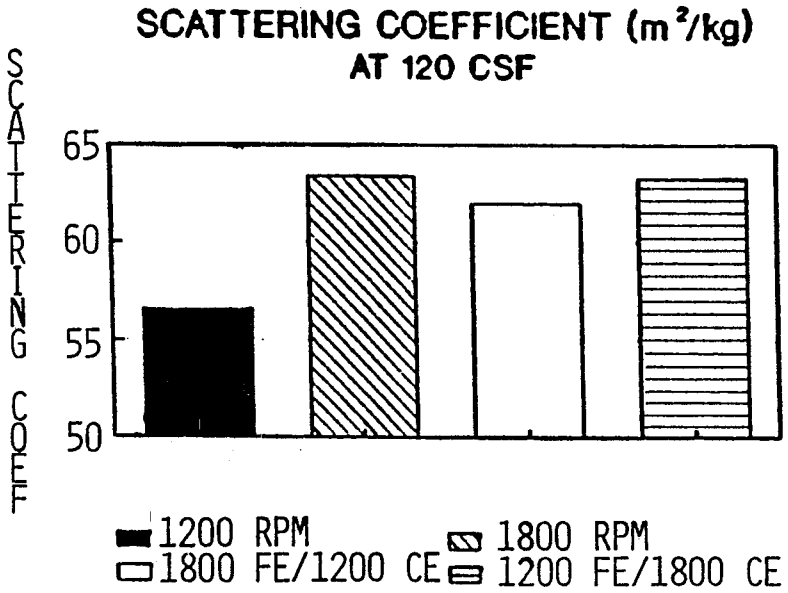

Scattering coefficient results at two different conditions are shown in FIGS. 13 and 14. From these data, it may be concluded that under all configurations, higher speeds result in a higher scattering coefficient and more surface area is generated.

Figure 16:
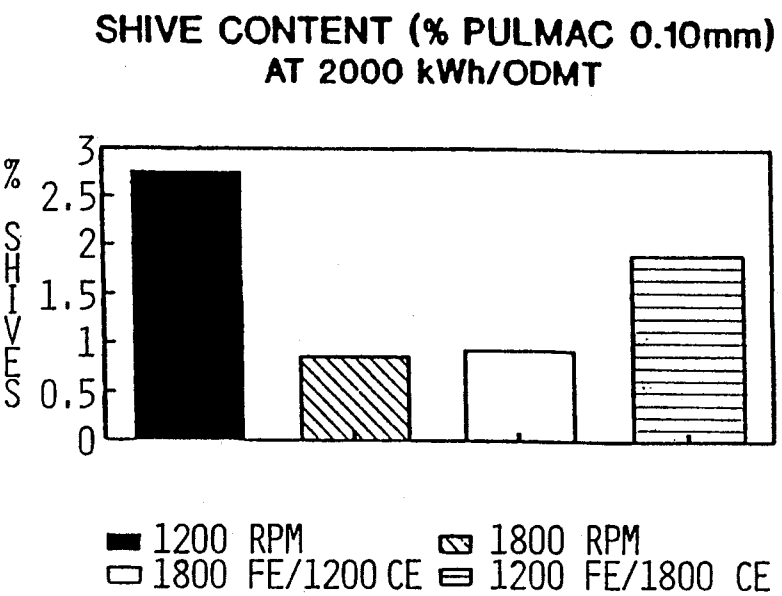
FIGS. 15 and 16 are graphic comparisons of shive content for the invention and known refiner configurations.
Figure 15:
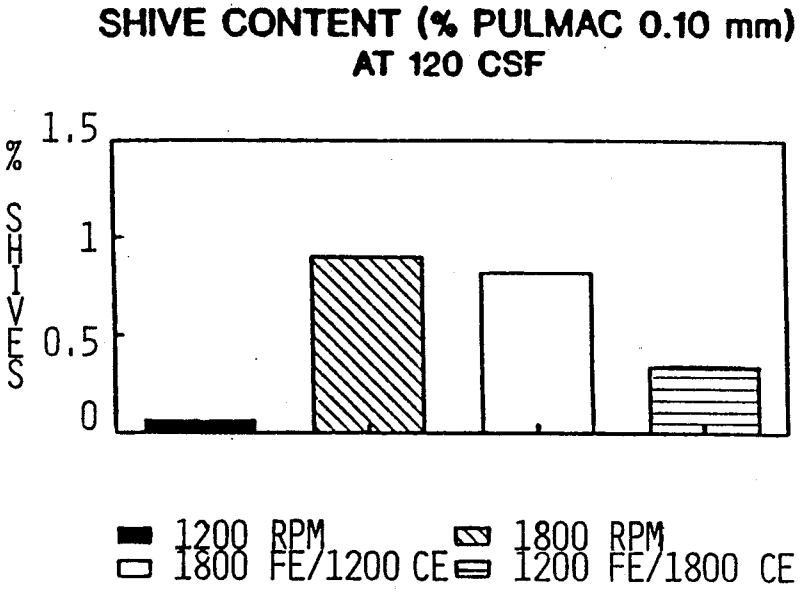
Figure 18:
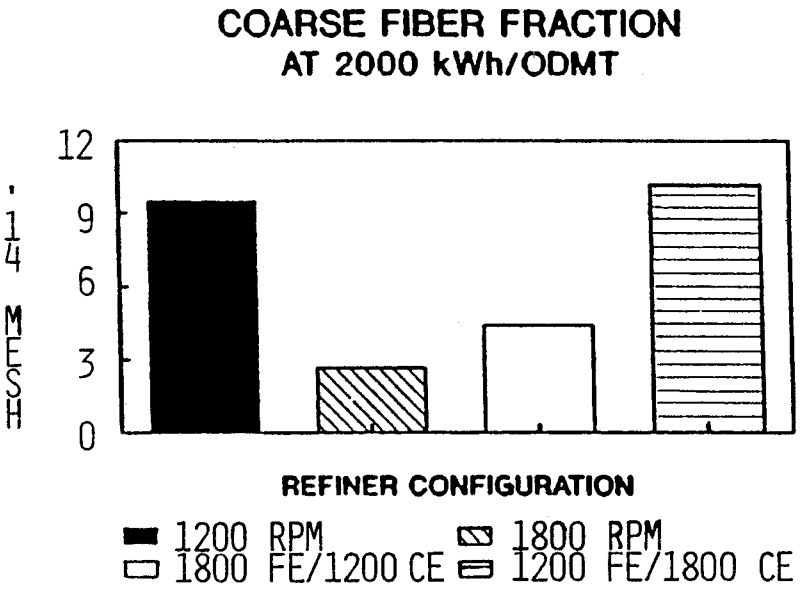
FIGS. 17 and 18 are graphic comparisons of coarse fiber fraction for the invention and known refiner configurations.
Figure 17:
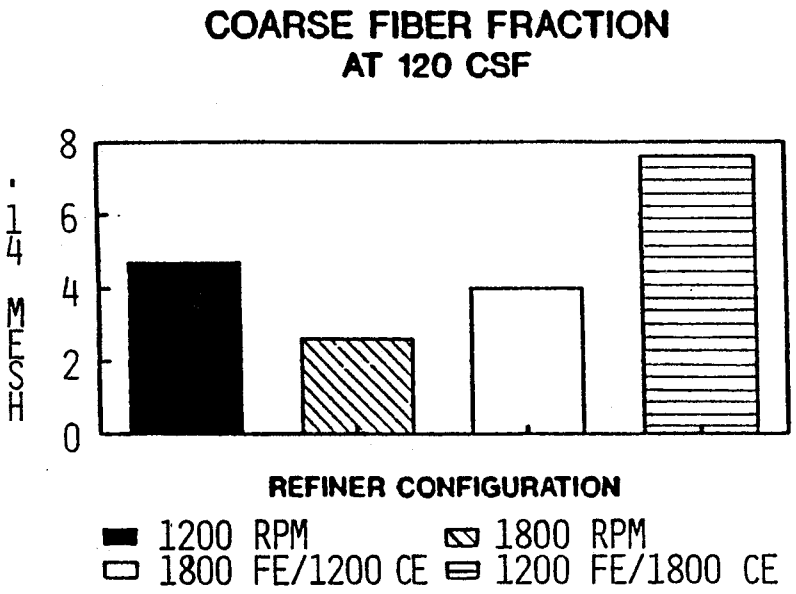
Figure 20:
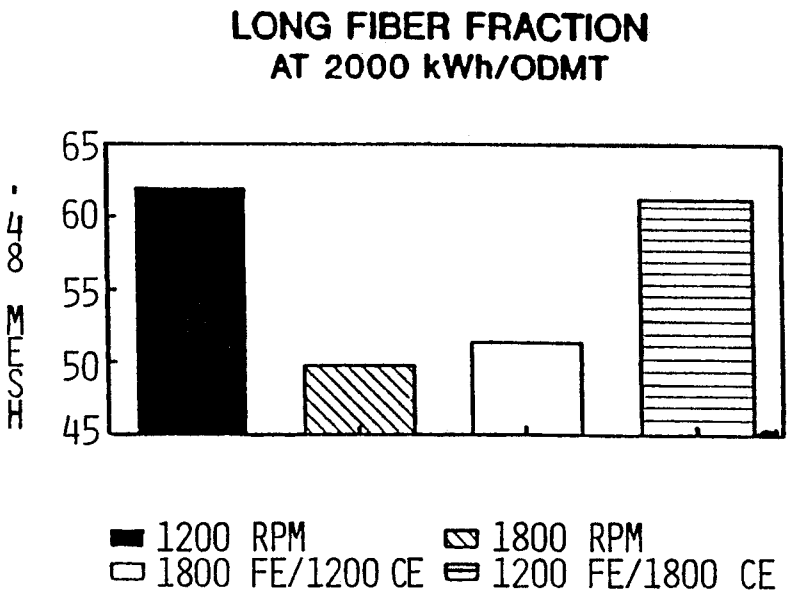
FIGS. 19 and 20 are graphic comparisons of long fiber fraction for the invention and known refiner configurations.
Figure 19:
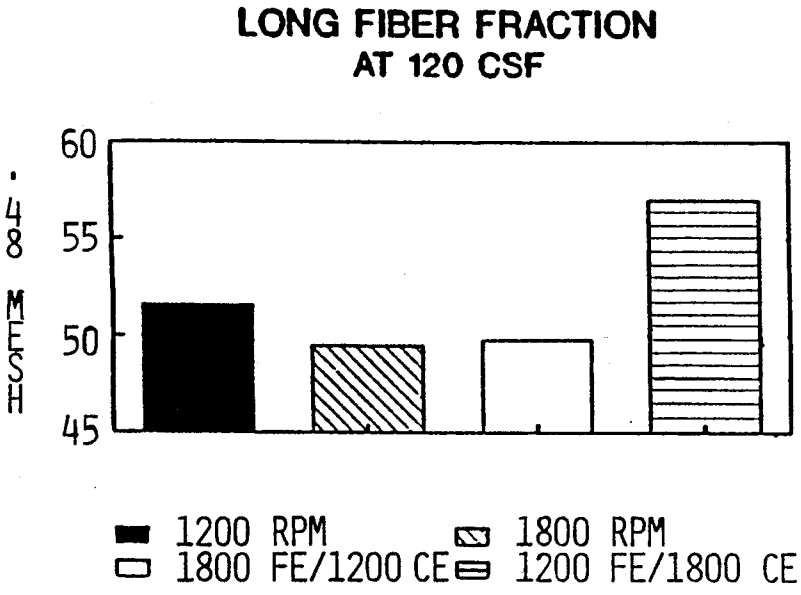

FIGS. 15 and 16 show a comparison of shive content at two conditions. For a given freeness, all configurations using a higher speed disc produce greater shive content, but when normalized to a specific power, the shive content with a higher speed disc is reduced.

FIGS. 17–20 show coarse and long fiber fraction under different conditions, from which it may be concluded that in every instance, the use of discs running at different speeds in the same refiner, produces an effect different from running both discs at the same speed.

Figure 22:
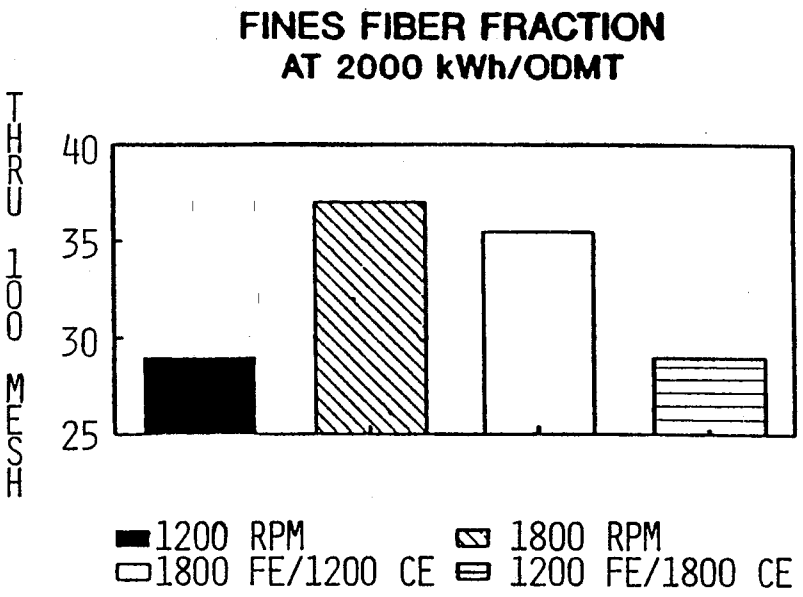
FIGS. 21 and 22 are graphic comparisons of the fines fiber fraction for the invention and known refiner configurations.
Figure 21:
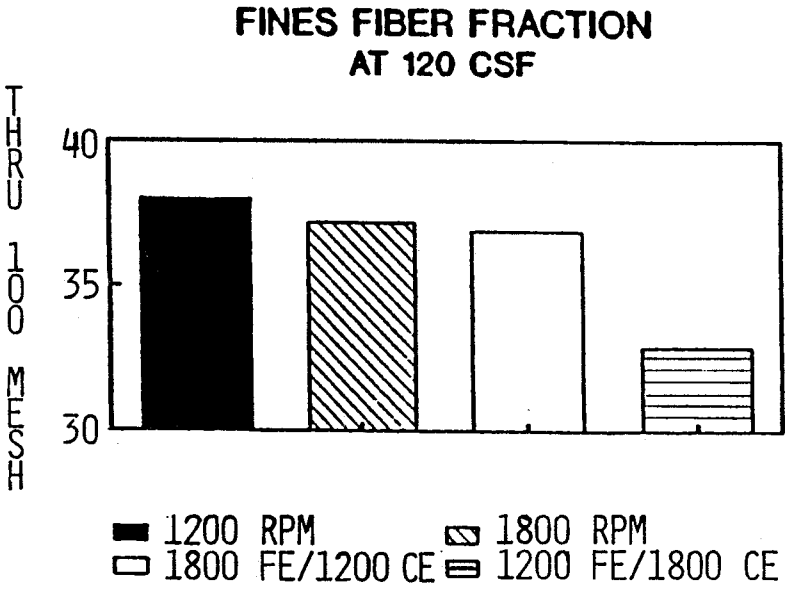

FIGS. 21 and 22 show a comparison of the fines fiber fraction, from which it may be concluded that running the feed end disc at the increased speed relative to the control end disc, can maintain the fines fiber fraction at a level substantially equal to that of running the discs at the same high speed.

Figure 24:
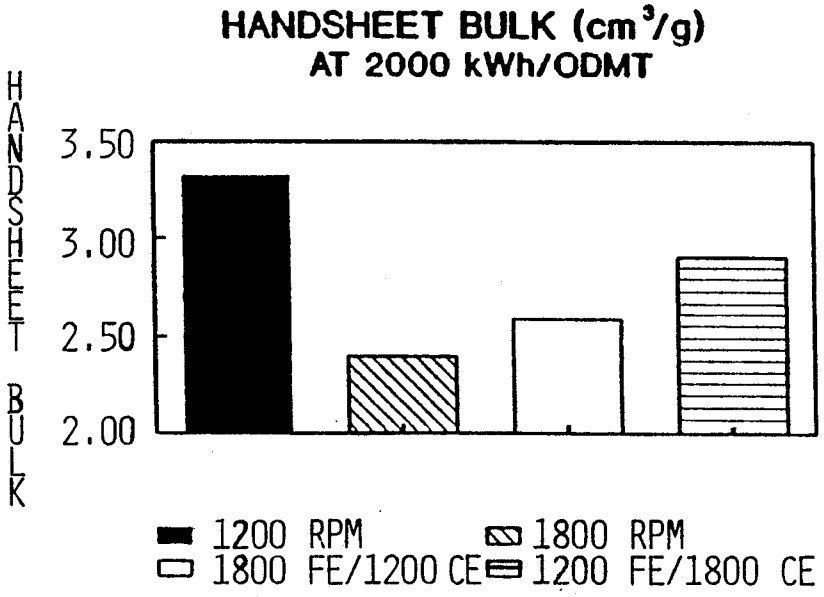
FIGS. 23 and 24 are graphic comparisons of the hand sheet bulk for the invention and known refiner configurations.
Figure 23:
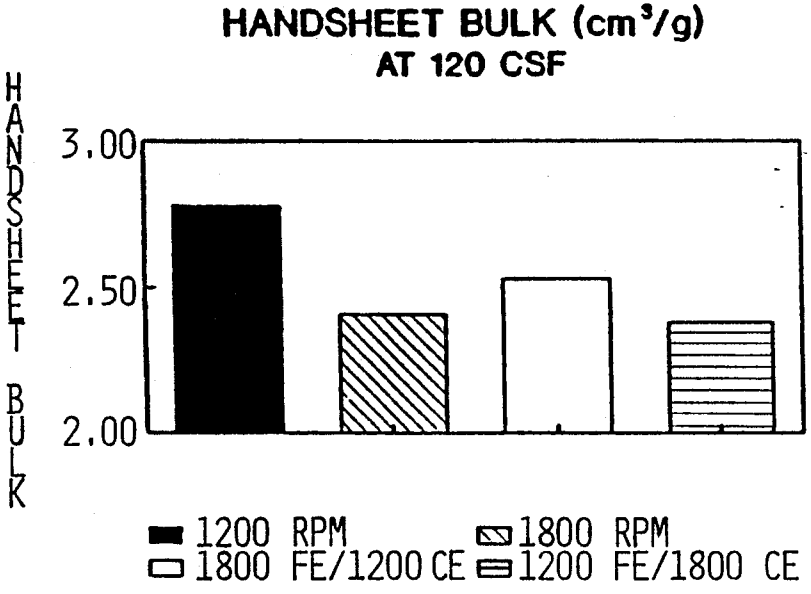

Finally, FIGS. 23 and 24 provide a comparison of hand sheet bulk, from which it may be concluded that operating either the feed and/or control end disc at the increased speed of 1800 rpm, results in a reduction in bulk relative to base line operation.

It should be appreciated that, conventionally, the motors in cabinets 22,24 shown in FIG. 1 are integral or coupled synchronous or induction motors which, in the steady state, rotate at the same fixed speed. These motors are conventionally connected directly to the shaft so that the shaft speed is the same as the motor speed. It should be understood that effectuating a change in the rotation speed of one shaft and associated disc, can be accomplished by replacing one motor, or by utilizing gear boxes, variable frequency power control, or equivalents. Another technique for increasing the speed of shaft rotation, is to modify an existing motor which has six poles operating at 1200 rpm, to four poles operating at 1800 rpm. Moreover, other drive means, such as steam turbines, could be used. For a given set of speeds, the power ratio to the two discs is automatically determined by virtue of the fact that the torques are always equal. Therefore, since power is a product of torque and speed, the power ratio of the drive means, e.g., motors, is proportional to the desired speed ratio. No other basis of power split is available.

Those skilled in the art will appreciate that if one shaft of a conventional double disc refiner is to rotate at an increased speed in accordance with the present invention, the bearings and associated mechanical seals may need upgrading in a straight-forward manner.

Although not absolutely necessary, the Topwinder feeder shown as mechanism 16 in FIG. 1 or its equivalent, is desirable to maintain high consistency in the feeding of the pulp into the refining zone. This helps maintain consistency in the output product. Similarly, although the plate clash protection system 38 shown in FIG. 1 is not absolutely necessary, the higher disc rotation speed such as 1800 rpm relative to the more usual 1200 rpm, requires running smaller gaps between the plates which in turn make possible plate clash more likely.

From the foregoing data, those skilled in the art can appreciate that the operation of each disc in a double disc refiner at a different speed, provides two kinds of significant advantages. First, relative to the base line configuration wherein each disc is operated at the same speed of 1200 rpm, the invention enables the operator to achieve similar levels of quality in many of the product characteristics, while realizing a savings in energy consumption, when the feed end disc is rotated at, for example, a 50 percent higher speed than the control end disc. Relative to the conventional method of operating both discs at the same low or high speed of 1200 or 1800 rpm, the present invention achieves other product quality characteristics which are not achievable with either of these conventional double disc refiner configurations. Moreover, beneficial results may be achieved by driving opposed refiner discs at different speeds, even if both discs have feed passages for introducing material into the refining zone.

APPENDIX

Glossary of Selected Terms

BONDING STRENGTH: A measurement that characterizes how well the fibers in a sheet of paper are bonded together. The test involves using an adhesive to bond something to the paper surface and then measuring the force required per unit area to pull the paper apart.

BURST INDEX: Burst strength/unit weight. Burst strength is determined in a lab test in which a test specimen of paper is clamped in an annular ring and subjected to increasing pressure of a rubber diaphram until the specimen ruptures. The pressure in KPa is recorded as burst pressure.

CSF: Canadian Standard Freeness, a measurement based on the rate that water drains from a mass of pulp. This is an easy test which helps to predict other pulp qualities. In general, more energy applied to the process reduces fiber and particle size which in turn reduces the rate of drainage. A lower numerical value corresponds to smaller fibers and particles.

FREENESS: Short for CSF.

HANDSHEET BULK: A measure of the specific volume of a small sheet of paper prepared by a standard lab setup using a sample of pulp.

INTENSITY: A measure of the rate that energy is applied to the material being refined. Commonly defined as specific energy per impact on the material as it passes through bar crossings or the like between opposed plate grinding surfaces. Specific energy is defined as power applied per unit of throughput.

ODMT: Oven dry metric tons per day.

PULMAC: A tester to determine shive content.

SCATTERING COEFFICIENT: A measure of how light reflects from a sheet of paper.

SHIVE CONTENT: The percentage of fiber bundles in a pulp sample which exceed a certain size. Shives are considered un-or underrefined portions of the pulp.

TEAR INDEX: Tear strength/unit weight. Tear strength is determined in a lab test in which a sample of paper is subjected to a tearing force. The force applied is the measurement.

TENSILE INDEX: Tensile strength/unit weight. Tensile strength is determined by subjecting a sample of paper to tension. The force per unit area at rupture is the recorded value.

TMP: Thermo-mechanical pulp. This is a pulp produced by disc type refiners in which the chips are softened in advance by pressurized steaming, followed by pressurized refining.

What is claimed is:

1. An improved method for refining pulp material between two coaxial, spaced apart, counter-rotating discs of substantially equal diameter, by introducing the feed material under pressure at a high consistency in the space adjacent the axis so that the material is refined between the discs as the material passes radially toward the disc circumference where it is extracted in a refined state, wherein the improvement comprises the step of counter-rotating the discs at steady-state speeds that are different by at least about 25 percent.

2. The method of claim 1, including the step of introducing the feed material into the space through an opening near the axis of one disc, and rotating said one disc faster than the other disc.

3. The method of claim 2, wherein the first disc is rotated approximately fifty percent faster than the second disc.

4. The method of claim 3, wherein the first disc is rotated at approximately 1800 rpm and the second disc is rotated at approximately 1200 rpm.

5. The method of claim 1, including the step of introducing the feed material into the space through a passage in one disc, and rotating the other disc faster than said one disc.

6. The method of claim 1, wherein the step of counter-rotating includes rotating one disc at a speed no greater than about 1500 rpm and rotating the other disc at a speed that is in the range of 25 to 75 percent greater than the speed of said one disc.

* * * * *